US009731325B2

(12) United States Patent
Hill

(10) Patent No.: US 9,731,325 B2
(45) Date of Patent: Aug. 15, 2017

(54) MOBILE MECHANICAL XERISCAPE GRAVEL CLEANER

(71) Applicant: Thomas R. Hill, Rio Rancho, NM (US)

(72) Inventor: Thomas R. Hill, Rio Rancho, NM (US)

( * ) Notice: Subject to any disclaimer, the term of this patent is extended or adjusted under 35 U.S.C. 154(b) by 3 days.

(21) Appl. No.: 14/694,842

(22) Filed: Apr. 23, 2015

(65) Prior Publication Data

US 2016/0310993 A1 Oct. 27, 2016

(51) Int. Cl.
*B07B 1/22* (2006.01)
*B07B 1/00* (2006.01)
*B07B 1/24* (2006.01)

(52) U.S. Cl.
CPC ..... *B07B 1/005* (2013.01); *B07B 1/24* (2013.01)

(58) Field of Classification Search
CPC .. B07B 1/005; B07B 1/22; B07B 1/24; B07B 11/06
See application file for complete search history.

(56) References Cited

U.S. PATENT DOCUMENTS 1,088,117 A * 2/1914 Walter ..... B07B 9/00 209/245
1,309,754 A * 7/1919 Dovel ..... B07B 1/24 209/270
4,127,478 A * 11/1978 Miller ..... B03B 5/56 209/240
4,312,749 A * 1/1982 Bingham ..... B03B 5/56 209/298
5,054,506 A * 10/1991 Shakeri ..... B09C 1/02 134/104.4
5,076,704 A * 12/1991 Serbousek ..... B01F 9/0007 198/368
5,108,584 A * 4/1992 Brosseuk ..... B03B 5/26 209/270
RE34,458 E * 11/1993 Fahrenholz ..... B02C 17/002 209/234
5,265,304 A * 11/1993 Hughes ..... B08B 15/00 15/302
5,398,814 A * 3/1995 Sime ..... B07B 1/24 209/285
5,752,435 A * 5/1998 Wai ..... A23N 15/02 15/3.16
6,360,894 B1 * 3/2002 Devlin ..... B07B 1/22 209/291

(Continued)

*Primary Examiner* — Joseph C Rodriguez

(57) ABSTRACT

Disclosed is mobile mechanical xeriscape gravel cleaner which is delivered to the site of the xeriscaping to be cleaned by a wheel/axle assembly, leveled with adjustable jack stands mounted on the metal frame. Xeriscape material to be cleaned is collected and deposited in a hopper with slide plate to control flow of material into the receiving chamber. Using an external power system, the auger/screener device rotation begins and picks up and carries forward the material, passing through the transition plate to the auger/cleaner chamber where foreign material passes through the screen. The cleaned material proceeds to the discharge chamber where it is collected and returned to the original xeriscaped site. The mobile mechanical xeriscape gravel cleaner can clean xeriscape gravel at a lower cost, with improved quality and a higher rate of speed than was previously possible, with significantly reduced burden to the ecosystem.

4 Claims, 9 Drawing Sheets

(56) References Cited

U.S. PATENT DOCUMENTS

| | | | | |
|---|---|---|---|---|
| 6,602,130 | B1 * | 8/2003 | Manning | A01F 12/444 209/30 |
| 6,827,222 | B1 * | 12/2004 | Nilsson | B07B 1/24 209/284 |
| 8,245,962 | B2 * | 8/2012 | Didion | B02C 17/002 241/251 |
| 8,381,916 | B2 * | 2/2013 | Bossen | B03B 5/00 209/270 |
| 9,073,088 | B2 * | 7/2015 | Walton | B07B 1/22 |
| 2014/0215731 | A1 * | 8/2014 | Hill | B07B 1/24 15/3 |
| 2015/0053594 | A1 * | 2/2015 | DeWaard | B07B 1/00 209/17 |

* cited by examiner 30
61
62
2
(16)
63
65
50
50

(18)

65
30
(15)
2
59
49

MOBILE MECHANICAL XERISCAPE GRAVEL CLEANER

CROSS REFERENCE TO RELATED APPLICATIONS

This application is a Continuation in Part of application Ser. No. 13/757,751 filed Feb. 2, 2013 of Thomas R. Hill for a MOBILE MECHANICAL XERISCAPE GRAVEL CLEANER.

STATEMENT REGARDING FEDERALLY SPONSORED R&D

None.

NAMES OF PARTIES TO A JOINT RESEARCH AGREEMENT

None.

BACKGROUND OF THE INVENTION

1. Field of the Invention

The present invention relates to the cleaning of xeriscape gravel utilizing a mobile mechanical cleaner to allow for an on-site process. It is a rotating auger screen assembly with a means of receiving a rotating force. Xeriscape gravel is collected from the site and loaded into a gravity flow chute which feeds it into a receiving chamber where it is picked up by the rotating auger screen assembly and fed through the cleaning chamber where dirt and debris fall through the screen for disposal and on to the discharge chamber where the cleaned xeriscape gravel is collected and returned to the site. The entire device can be sized to facilitate accessing most areas of residential and commercial properties without difficulty and screen can be easily changed to accommodate cleaning of varied sizes of xeriscape gravel.

2. Description of the Prior Art

Previous efforts to clean xeriscape gravel has been labor intensive and marginally effective either using a handheld shaker screen box cleaning very small quantities or using a front end loader device and dumping the xeriscape onto a larger screen to allow some of the dirt and debris to filter through. Both systems have only partially cleaned the gravel in a single process. Currently, xeriscape gravel is not often commercially cleaned due to the time required, the quality of cleaning and the labor costs associated. Rather the gravel is collected and hauled to a landfill and the property owner buys new gravel to replace it at significant cost.

U.S. Pat. No. 5,054,506; Name of Patentee—Shakeri; Date of Patent—Oct. 8, 1991: A rock and gravel cleaner is disclosed. The rock and gravel cleaner includes a tank having a frame, a water heater connected to the tank, a motor containing an idler pulley arrangement and a fan belt, and a revolving cylinder having a reel at each end revolves via the energy transported from the motor to the reel by the fan belt so that the cylinder revolves on the frame.

This device is intended to extract oil and other pollutants utilizing hot water spray into a hollow screened tube and collecting said extraction for recycling of the oil rather than for the purpose of cleaning the gravel or rock for recycling. This is not a mobile device and would not be appropriate for the cleaning of commercial or residential xeriscape gravel.

SUMMARY OF THE INVENTION

The mobile mechanical xeriscape gravel cleaner is a mobile machine which can be taken to a property with xeriscape gravel, clean and replace the existing gravel faster, cleaner and more economically than previously methods. Further, it is environmentally friendly in that uncleaned gravel is not going to a landfill and the cleaned xeriscape gravel reduces soil erosion and deters the growth of weeds on the property. Due to drought conditions, particularly in the southwestern states, many communities are requiring a percentage of all urban properties to be xeriscaped to reduce water consumption. It is an auger screen assembly with a means for receiving a rotating force, such as a variable speed eternal power driven motor or engine, hydraulic and/or gear, chain and sprocket system. Xeriscape gravel is collected from the site and loaded into a gravity flow chute which feeds it into a receiving chamber where it is picked up by the rotating auger screen assembly and fed through the cleaning chamber on to the discharge chamber where the cleaned xeriscape gravel is collected and returned to the site. The entire device can be sized to facilitate accessing most areas of residential and commercial properties without difficulty and screen can be easily changed to accommodate cleaning of varied sizes of xeriscape gravel.

DETAILED DESCRIPTION OF THE INVENTION

1. Best Mode of Invention

FIG. 1A through FIG. 9B show the best mode contemplated by the inventor of the mobile mechanical xeriscape gravel cleaner according to the concepts of the present invention.

2. How to Make the Invention

Figure 1A:
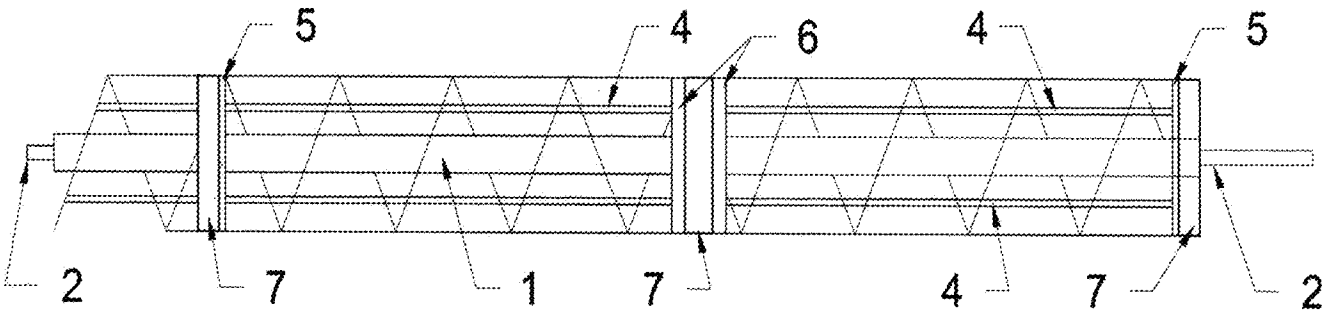
FIG. 1A is the auger with end shafts, auger support bar plates, auger support bars, and screen support bands.
Figure 1B:
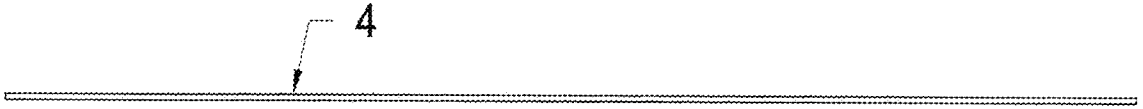
FIG. 1B is the screen support bar.
Figure 1C:
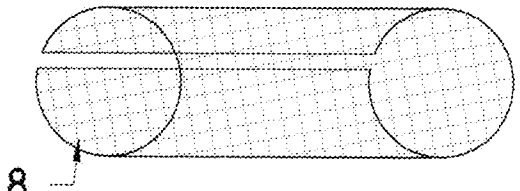
FIG. 1C is the screen support bands and screen.
Figures 2A, 2B, 2C:
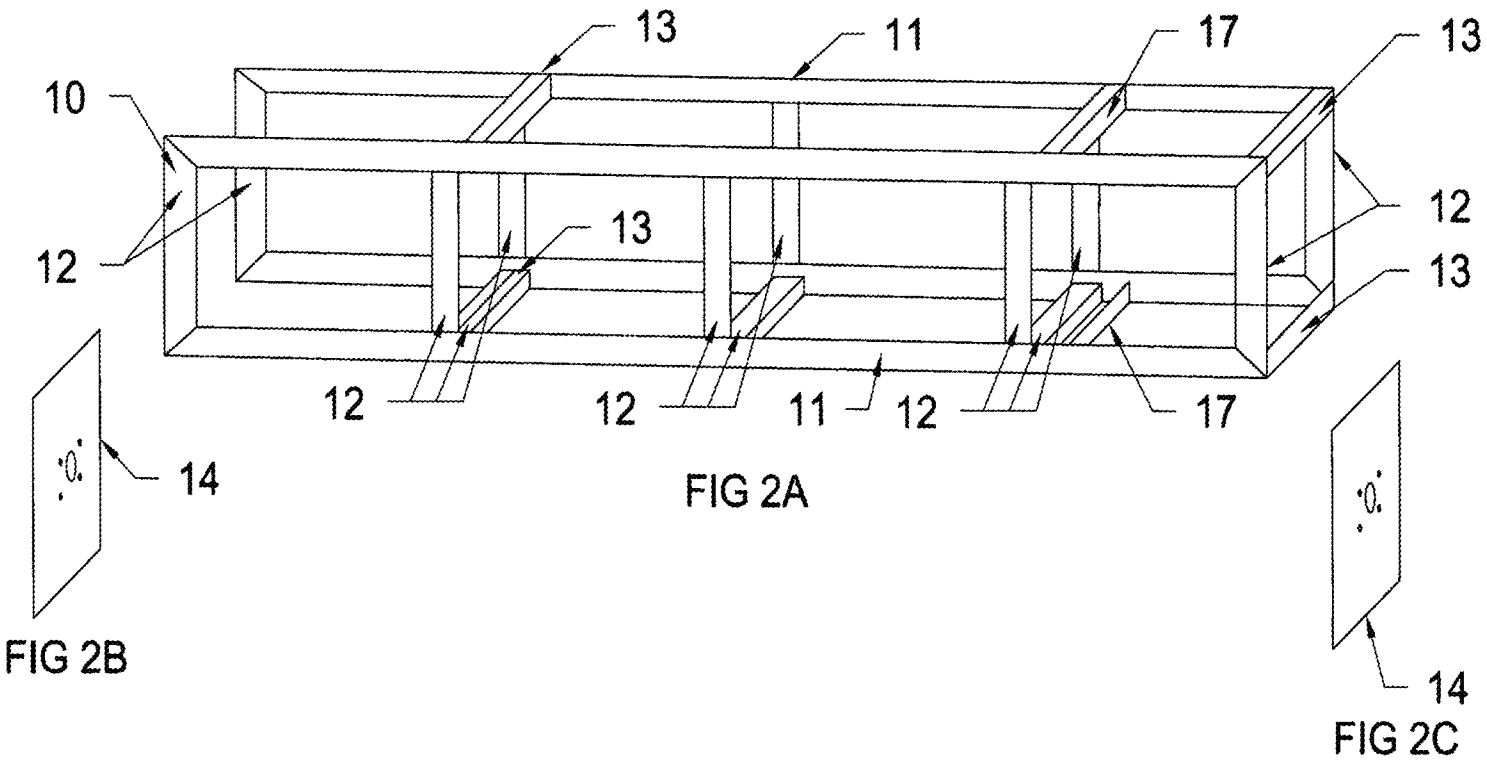
FIG. 2A is an isometric view of the welded metal frame to receive the auger assembly.
FIG. 2B is an isometric view of the drilled end plate to be mounted to the end of the discharge chamber and the front of the cylindrical material.
FIG. 2C is an isometric view of the transition plate with mounting tabs for cylindrical material and mounting angle support braces which will be mounted at the end of the receiving chamber and the front of the cleaning chamber.

As can be amply seen from the FIG. 1A to 1C of the mobile mechanical xeriscape gravel cleaner an auger 1 is a single or double flight design to move landscape gravel to be cleaned through its entire length and is equipped and bolted to auger end shaft 2 end plate 14 (FIGS. 2B and 2C). The auger flights are notched equal distance around its circumference to accept the auger support bars 4 along its length and welded in place. The screen support bands 5 are then welded to the front of the cleaning chamber 18 and the end of the cleaning chamber 18 and screen support 6 is welded midway in the cleaning chamber 18. The screen support bands 7 are welded on top of the previously placed screen support bands 5 and 6, flush with the outer edge of screen support bands 5 and centered on screen support band 6. Two sections of screen 8 are rolled and mounted on the outside of the auger 1 overlapping the inner screen support bands 5 and 6 and secured with metal screws and shoulder washers 65. The screen 8 grid size is determined by the size of the material to be cleaned.

Figure 3:
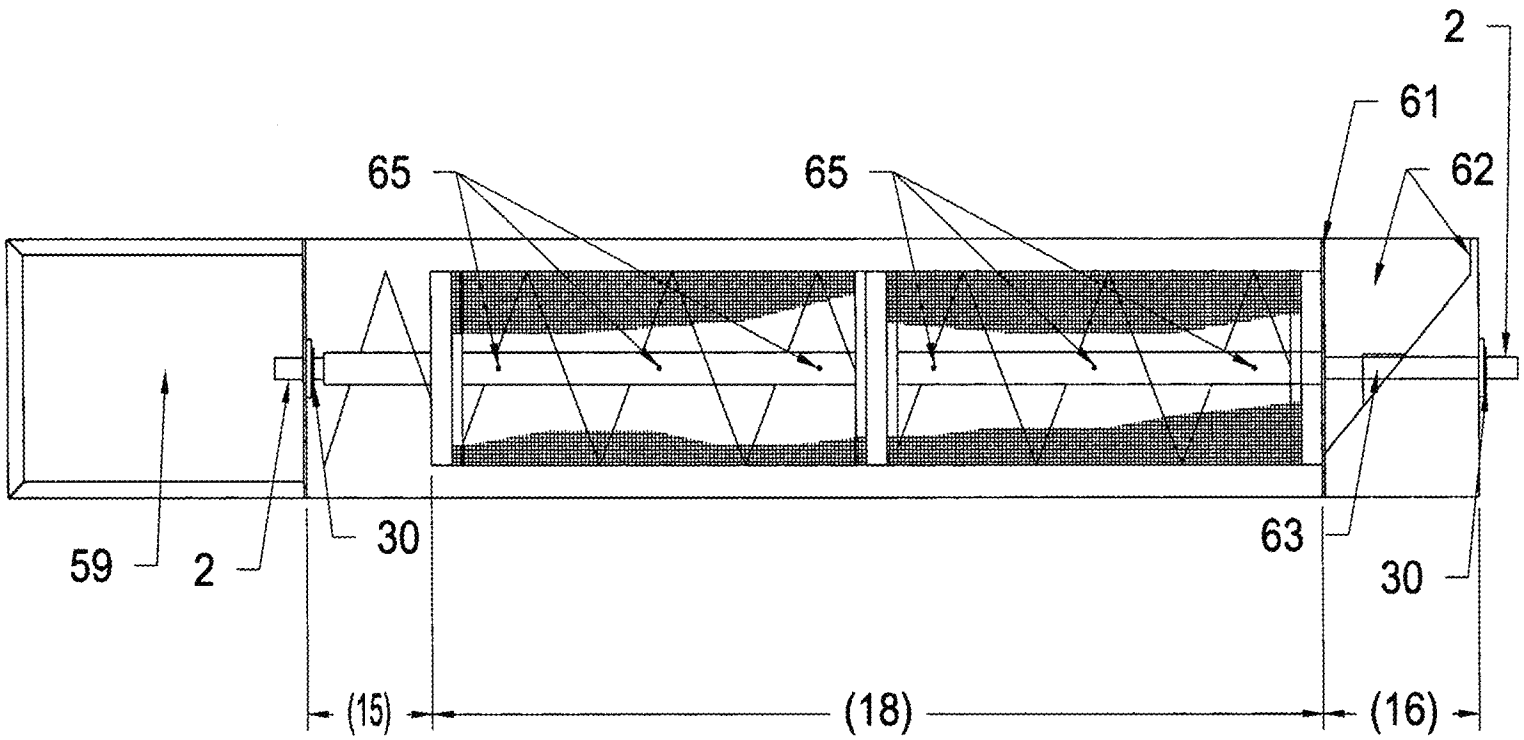
FIG. 3 is a top view of the welded metal frame, auger assembly, lubricated bearings, the receiving chamber, cleaning chamber and discharge chamber.

As can be amply seen from FIG. 2A to 2C, an isometric view, and FIG. 3, a side view of the mobile mechanical xeriscape gravel cleaner a welded metal frame 10 consists of rectangular tubing 11 with vertical and horizontal supports 12 spaced equally along its distance of sufficient length to accommodate auger assembly and accommodate a means for receiving a rotating force. Angle iron 13 is welded to the beginning of a receiving chamber 16 and the end of a discharge chamber 15 mount end plates 14. The end plates 14 serve as the mounting structure for the lubricating bearings 30 and dimensions of end plates 14 are determined by the height and width of the welded metal frame 10. The end plates 14 are drilled to receive the lubricated bearings 30 which are then bolted in place. The end plate 14 of the receiving chamber 16 is then bolted to the beginning of the receiving chamber 16 with the lubricated bearing 30 facing out and the end plate 14 of the discharge chamber is then bolted to the end of discharge chamber with the lubricated bearing facing into the discharge chamber. Angle braces 17 are welded to the welded metal frame 10 flush with the top and bottom end of the receiving chamber 16 before the cleaning chamber 18 to facilitate mounting of a transition plate 61. The transition plate 61 size is determined by the dimensions of the welded metal frame 10 and the size of the auger 1 used.

Figure 4B:
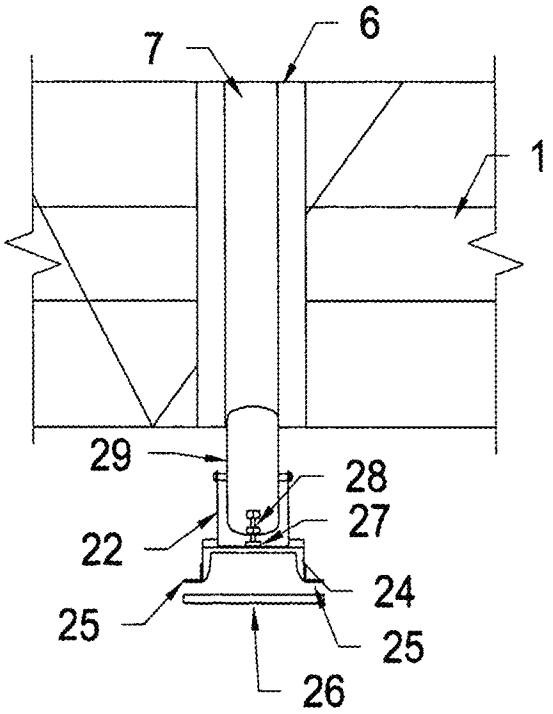
FIG. 4B is an enlarged side view of the adjustable roller wheel assembly detail.
Figure 4A:
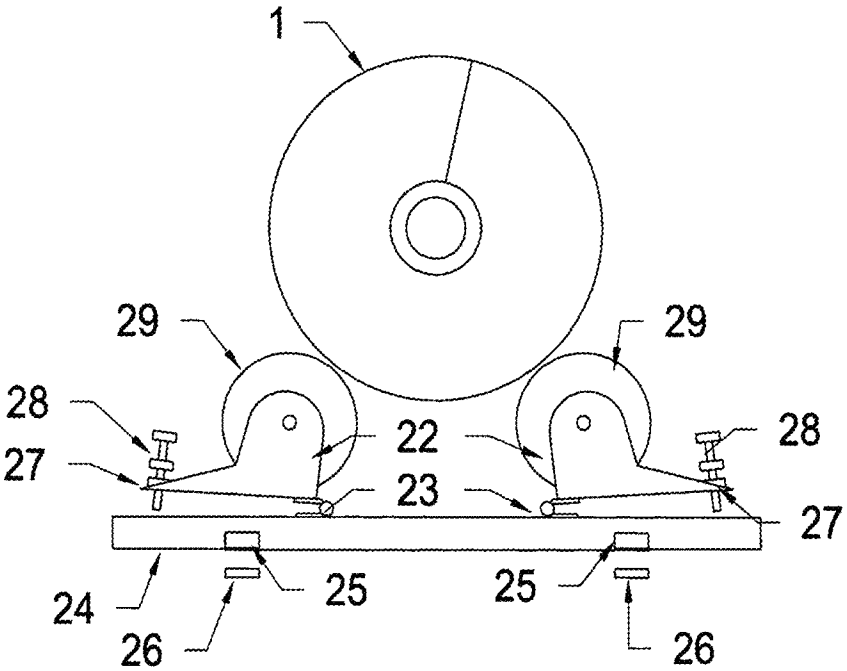
FIG. 4A is an enlarged end view of the adjustable roller wheel assembly detail.
Figure 5B:
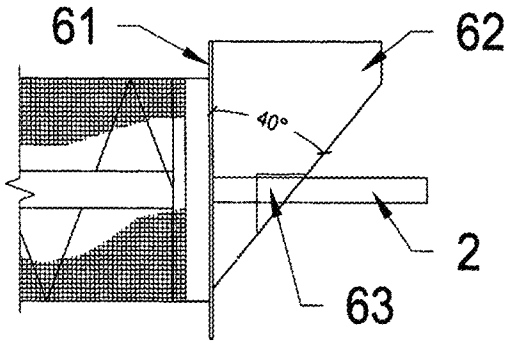
FIG. 5B is a side view of the gravity flow chute including shaft.
Figure 5A:
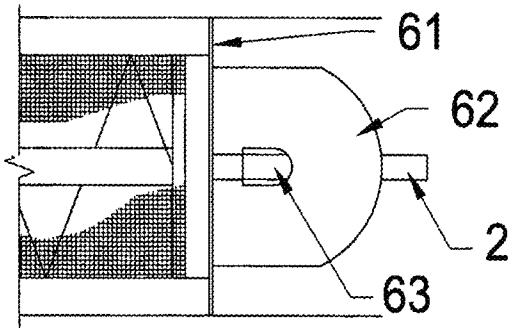
FIG. 5A is a top view of the gravity flow chute including shaft.
Figure 5C:
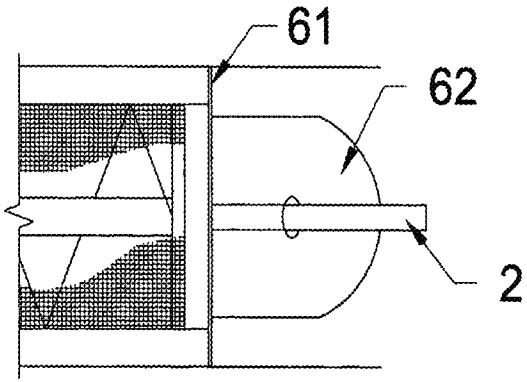
FIG. 5C is a bottom view of the gravity flow chute including shaft.
Figure 6B:
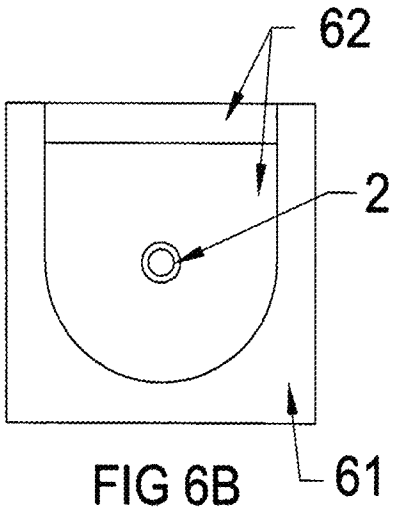
FIG. 6B is an end view of the transition plate from the receiving chamber side.
Figure 6A:
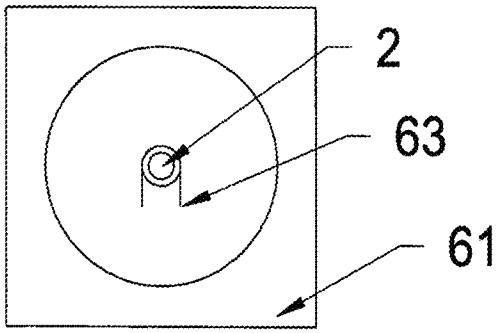
FIG. 6A is an end view of the transition plate from cleaning chamber side with the gravity flow chute and shaft guard.

As can be amply seen from the FIGS. 4A and 4B of the mobile mechanical xeriscape gravel cleaner, two adjustable roller wheel assemblies are required, each composed of a bracket 22 with a hole to allow attachment to the wheel 29. A hinge 23 is welded to the bracket 22 at the inside edge of the bracket 22, welded to a channel iron 24 and placed over the middle horizontal support 12 (FIG. 2A). Angle iron tabs 25 are welded to the outer edge of the channel iron 24 with a flat bar underneath the horizontal support 12 (FIG. 2A) located at midpoint of the welded metal frame 10. A nut 27 is welded to the outer edge of the bracket 22. A bolt and locking nut 28 is placed in the nut 27 to facilitate adjustment of the adjustable roller wheel assemblies to support the middle auger support band 7 on both sides of the auger assembly.

As can be amply seen from FIG. 5A to C and FIGS. 6A and 6B, the gravity flow chute is preformed metal in a "U" shape with a 40 degree slope and a hole for passage of the extended auger shaft 2 which is welded to the transition plate 61 from the top of the transition plate 61 down and around the outer edge of the opening in the transition plate 61. The shaft guard 63 is positioned over the shaft opening in the gravity flow shoot 62 and welded in place. Locate the discharge chamber 15 end of auger 1 insert it first into the cleaning chamber with and the auger flighting against the cleaning chamber side of the transition plate. Extend the auger shaft on through the auger shaft opening and auger guard and into the lubricated bearing on the discharge chamber end of the welded metal frame 10 and slide the auger end shaft 2 toward the discharge chamber end of the welded metal frame 10 and insert the auger end shaft 2 into the lubricated bearing 30 on the discharge chamber 15 end of the welded metal frame, bolt into place and check to see auger 1 rotates freely.

Figures 7A, 7B, 7C:
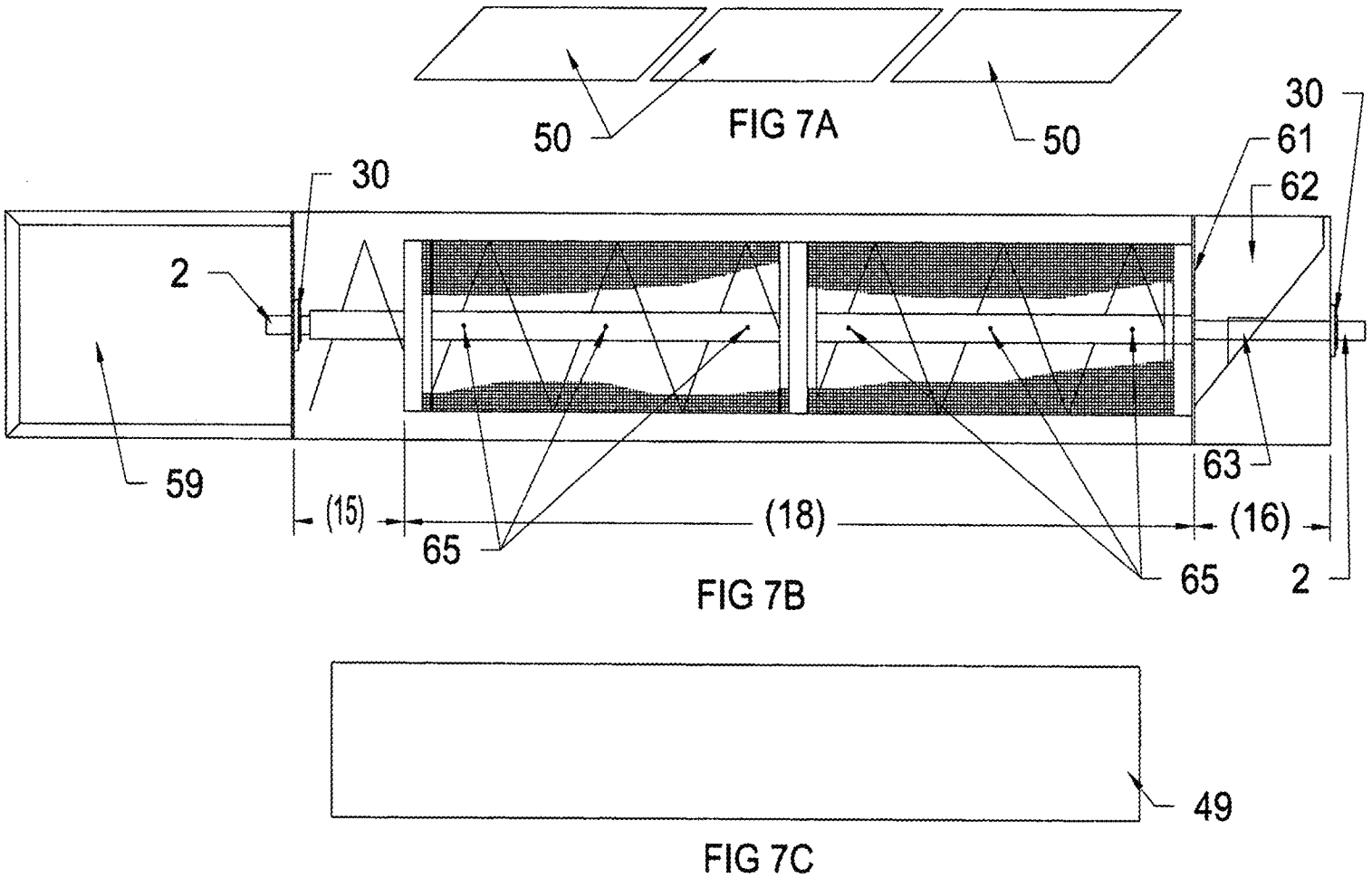
FIG. 7A is the side view of the welded metal frame including the auger assembly and cylindrical material, divided into receiving, cleaning and discharge chambers with location of the variable speed external power drive and chain and sprocket drive, control panel and hopper.
FIG. 7B is the cover plates to be fastened and hinged to the top of the welded metal frame and the engine mounting plate to be fastened to the welded metal frame.
FIG. 7C is the side panels to be applied to the lateral sides of the welded metal frame.

As can be amply seen from the FIGS. 7A, 7B and 7C of the mobile mechanical xeriscape gravel cleaner side panels 49 of solid thin gauge metal are fastened to the welded metal frame 10 on the interior of the both horizontal surface. There are three cover plates 50 hinged and fastened to the top of the welded metal frame 10 for the purpose of inspection, maintenance and worker safety. The welded metal frame 10 extends to create a space 59 to accommodate mounting of a means for receiving a rotating force.

Figures 8A, 8B, 8C:
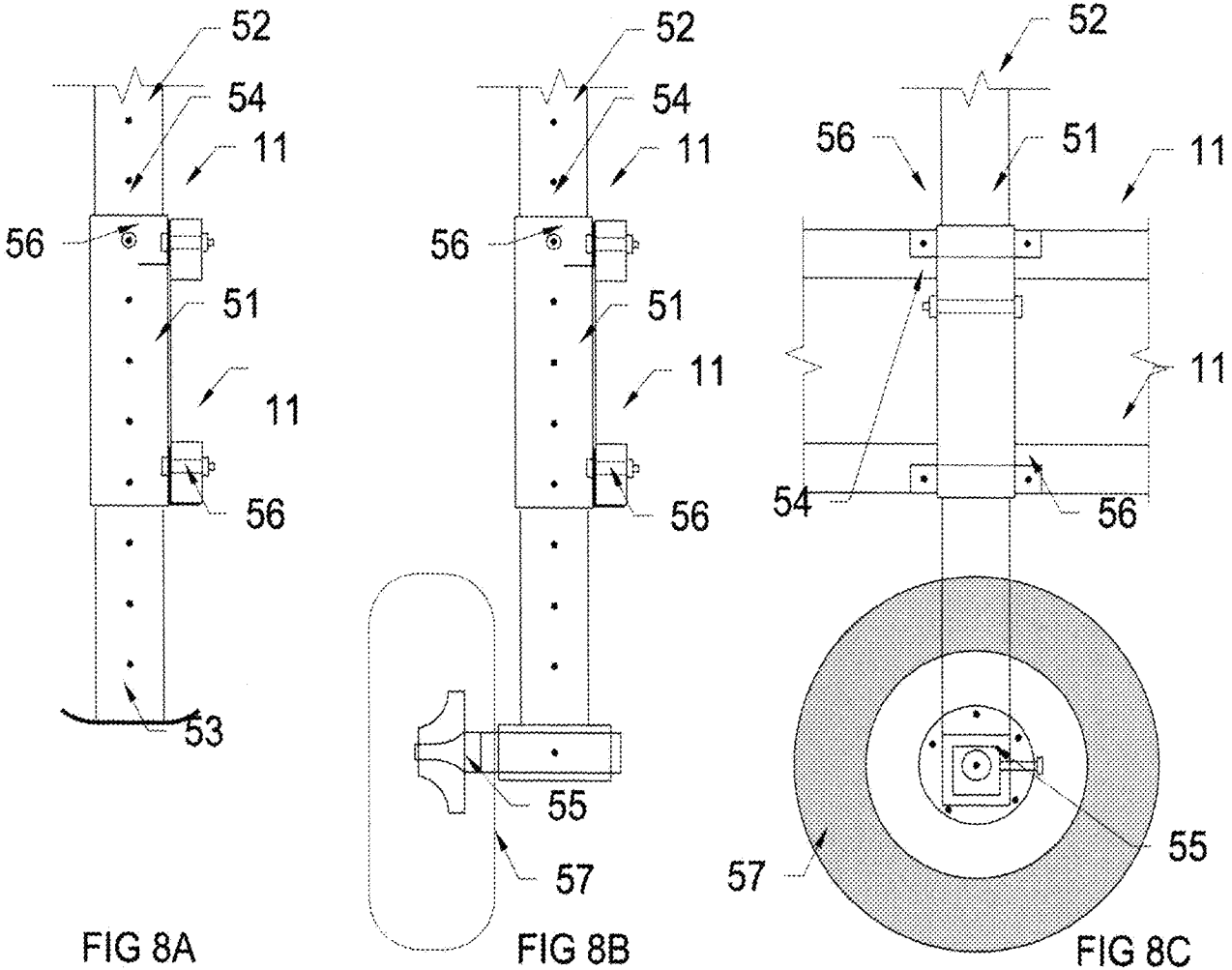
FIG. 8A is an end view of the adjustable independent support jack.
FIG. 8B is a side view of the adjustable independent axle with wheel and flotation tire.
FIG. 8C is a side view of the adjustable independent axle with wheel and flotation tire.

As can be amply seen from the FIGS. 8A, 8B and 8C of the mobile mechanical xeriscape gravel cleaner at the receiving chamber end and mounted to the each side of the welded metal frame are adjustable independent support jacks to add stability and allow leveling of the device during operation. The adjustable independent support jacks are constructed from a length of square tubing 51, pre-drilled for slide adjustment. Two length of angle iron 56 are welded to the upper and lower edge of larger square tubing 51 for bolt mounting to the welded metal frame 10. A length of inner square tubing 52 of slightly smaller dimension, also pre-drilled for slide adjustment is inserted into the aforementioned larger square tubing 51. A bolt 54 suitable to fit through the pre-drilled holes in the square metal tubing 51 and 52 is used to secure the inner and outer square tubing 51 and 52 at adjustment height. A flat plate is welded to the bottom of the inner tube 52 with edges bent up to form a foot plate 53 for the adjustable independent support jack stand. The adjustable independent support jack stand is mounted on the receiving chamber end of the welded metal frame 10. An adjustable independent axle with wheel and floatation tire will be constructed as the adjustable independent support jack stand, however in place of a foot plate a standard spindle and hub 55 will be attached to the bottom of the inner tubing 52 and a flotation wheel/tire 57 assembly of appropriate size to facilitate mobility of the mobile mechanical xeriscape gravel cleaner will be attached to the aforementioned hub 55 with lug nuts. The angle iron 56 of the adjustable independent axle with wheel and floatation tire will and a flotation wheel/tire 57 assembly of appropriate size to facilitate mobility of the mobile mechanical xeriscape gravel cleaner will be attached to the aforementioned hub 55 with lug nuts. The angle iron 56 of the adjustable independent axle with wheel and floatation tire will be welded to the larger square metal tubing 51 and bolted to the rectangular tubing 11 of the welded metal frame 10 at sixty percent of the length of the welded metal frame 10 from the receiving chamber 16 end.

Figures 9A, 9B:
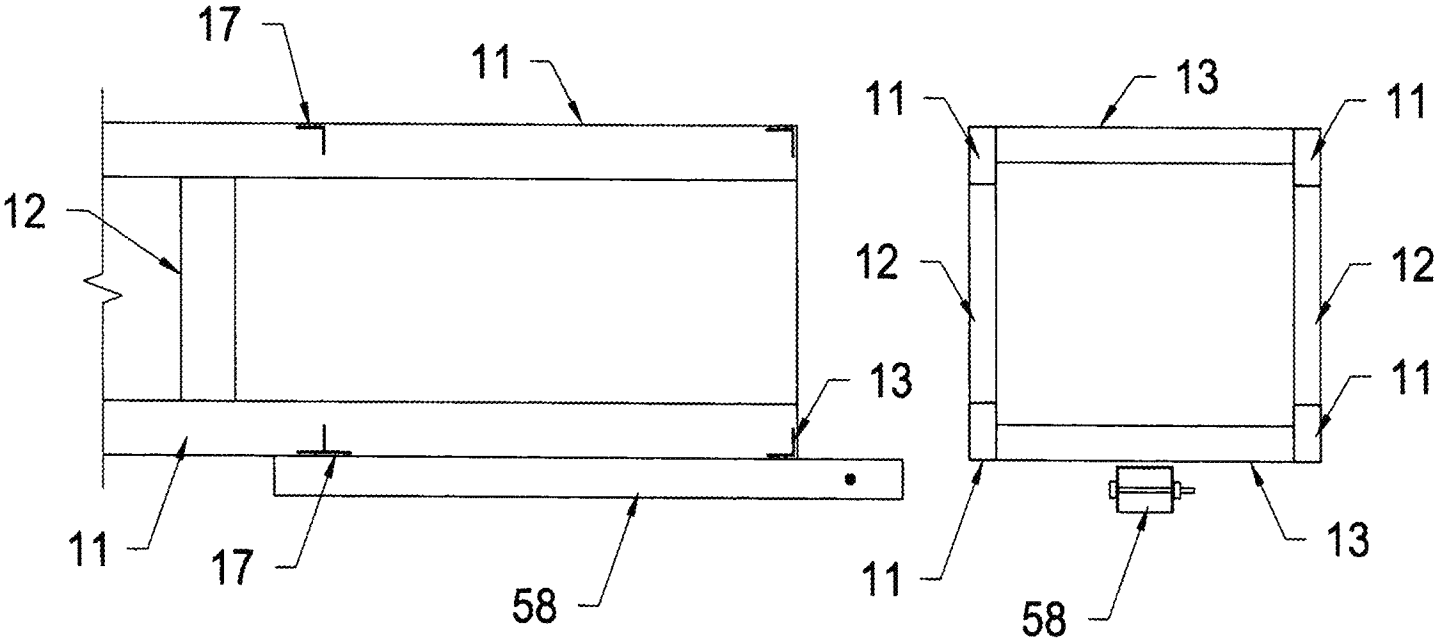
FIG. 9A is the side view of the application of a square receiver tubing to accept a common receiver hitch.
FIG. 9B is an end view of the square receiver tubing to accept a common receiver hitch.

As can be amply seen from the FIGS. 9A and 9B of the mobile mechanical xeriscape gravel cleaner a length of square tubing 58 is welded to the existing lower surface angle irons 13 and 17 on receiving chamber end of the mobile mechanical xeriscape gravel cleaner which will accept a common receiver hitch for the purpose of towing the mobile mechanical xeriscape gravel cleaner when desired.

What is claimed is:

1. A mobile mechanical xeriscape gravel cleaner comprising;

a metal frame with a receiving end and a discharge end, comprising; a plurality of longitudinal struts, a plurality of stabilizing cross members connecting the plurality of longitudinal struts, a receiving end plate at the beginning of the receiving end, a discharge end plate at the end of the discharge end, and an auger assembly rotatably attached to each end plate;

the auger assembly comprising a central shaft, at least one flighting helically attached to the central shaft, a plurality of support bars attached to the outer circumference of the at least one flighting along the length of the auger assembly, a plurality of screen support bands, each screen support band attached around the at least one flighting, a cylindrically shaped screen attached around the circumference of the at least one flighting to the support bars and support bands along the length of the auger assembly;

a receiving chamber comprising a U-shaped gravity flow chute on the receiving end of the metal frame;

a discharge chamber comprising an opening on the discharge end of the metal frame; and wherein the metal frame of the mobile mechanical xeriscape gravel cleaner is positioned at an angle less than 20 degrees horizontal in either direction.

2. The mobile mechanical xeriscape gravel cleaner of claim 1, wherein the metal frame of the mobile mechanical xeriscape gravel cleaner is positioned at an angle less than 18 degrees horizontal in either direction.

3. The mobile mechanical xeriscape gravel cleaner of claim 1 further comprising:

an equipment space extending from the discharge chamber to the end of the metal frame to receive a device to provide a means for delivering a rotating force to the auger.

4. The mobile mechanical xeriscape gravel cleaner of claim 1 further comprising at least one central support roller adjustably attached to the metal frame wherein the at least one central support roller rides on the at least one of the plurality of screen support bands to add support to the auger assembly.

* * * * *